US008769743B2

(12) United States Patent
Sanders

(10) Patent No.: US 8,769,743 B2
(45) Date of Patent: Jul. 8, 2014

(54) COVER AND RELATED PRODUCTS, AND PRODUCTION THEREOF

(75) Inventor: Hans Christian Sanders, Osnabruck (DE)

(73) Assignee: Sanders GmbH, Osnabruck (DE)

( * ) Notice: Subject to any disclaimer, the term of this patent is extended or adjusted under 35 U.S.C. 154(b) by 576 days.

(21) Appl. No.: 13/056,500

(22) PCT Filed: Jul. 31, 2009

(86) PCT No.: PCT/EP2009/059944
§ 371 (c)(1),
(2), (4) Date: Apr. 25, 2011

(87) PCT Pub. No.: WO2010/012826
PCT Pub. Date: Feb. 4, 2010

(65) Prior Publication Data

US 2011/0185500 A1 Aug. 4, 2011

(30) Foreign Application Priority Data

Jul. 31, 2008 (DE) ..... 10 2008 035 803
Jan. 29, 2009 (DE) ..... 20 2009 001 057 U

(51) Int. Cl.
*A47G 9/00* (2006.01)

(52) U.S. Cl.
USPC ..... 5/502; 5/923; 5/500

(58) Field of Classification Search
USPC ..... 5/482, 486, 500–502, 923
See application file for complete search history.

(56) References Cited

U.S. PATENT DOCUMENTS

| | | | | |
|---|---|---|---|---|
| 2,335,642 | A | 11/1943 | Butler | |
| 2,808,596 | A | 10/1957 | Schreiner | |
| 4,097,631 | A * | 6/1978 | Wilken | 428/114 |
| 4,631,765 | A * | 12/1986 | Casey | 5/417 |
| 5,269,862 | A | 12/1993 | Nakajima et al. | |
| 5,713,089 | A * | 2/1998 | Ferrante | 5/502 |
| 6,904,855 | B2 * | 6/2005 | Xu | 112/475.08 |
| 6,934,985 | B2 | 8/2005 | Sanders | |
| 2004/0231055 | A1 | 11/2004 | Sanders | |
| 2005/0210586 | A1 | 9/2005 | Pedersen et al. | |
| 2006/0021147 | A1 | 2/2006 | Inaba | |
| 2006/0277950 | A1 | 12/2006 | Rock | |

FOREIGN PATENT DOCUMENTS

| | | | |
|---|---|---|---|
| CH | 41 422 | A | 10/1908 |
| CN | 2619532 | Y | 6/2004 |
| CN | 201036456 | Y | 3/2008 |
| DE | 1 741 313 | U | 3/1957 |
| EP | 0 448 714 | A1 | 10/1991 |
| EP | 1 499 221 | B1 | 7/2005 |

(Continued)

OTHER PUBLICATIONS

International Search Report issued in corresponding PCT/EP2009/059944.

(Continued)

*Primary Examiner* — Fredrick Conley
(74) *Attorney, Agent, or Firm* — McCarter & English, LLP; Danielle L. Herritt

(57) ABSTRACT

The present invention relates to covers and in particular covers for beds which are characterized by the presence of two or more groups of strips, wherein each group comprises two or more strips arranged relative to one another in different directions and in particular woven together.

19 Claims, 4 Drawing Sheets

(56) References Cited

FOREIGN PATENT DOCUMENTS

| | | | |
|---|---|---|---|
| RU | 2001635 | C1 | 10/1993 |
| RU | 2136250 | C1 | 9/1999 |
| RU | 2185767 | C2 | 7/2002 |
| RU | 230 7628 | C2 | 10/2007 |
| WO | WO 91/18542 | | 12/1991 |
| WO | WO-92/18036 | A1 | 10/1992 |
| WO | WO 2008/086633 | | 7/2008 |
| WO | WO-2008/086633 | A1 | 7/2008 |

OTHER PUBLICATIONS

English translation of International Search Report of PCT/EP2009/059944 dated Feb. 4, 2010.

* cited by examiner

COVER AND RELATED PRODUCTS, AND PRODUCTION THEREOF

RELATED APPLICATIONS

This application is a 35 U.S.C. §371 national stage filing of International Application No. PCT/EP2009/059,944, filed Jul. 31, 2009, which is related and claims priority to DE Application Serial No. 102008035803.7, filed Jul. 31, 2008, and DE Application Serial No.: 202009001057.0, filed Jan. 29, 2009. The entire contents of these applications are explicitly incorporated herein by reference.

TECHNICAL FIELD OF THE INVENTION

The present invention relates to covers, and in particular covers for beds, sleeping bags, animal blankets, travel and day blankets, as well as to pillows and items of clothing.

BACKGROUND TO THE INVENTION

Currently covers are known from the prior art which are characterised e.g. by a casing of finely woven cotton material, and which are filled with feathers and/or down. Also known are covers with which small balls of synthetic fibres are used as a filler material. In addition there are so-called quilted covers with which a more or less voluminous layer of non-woven fabric as a filling is quilted with outer woven layers. Moreover, in particular in southern countries, simple covers, e.g. made of wool, folded into bed sheets are used as covers.

All of these variations of covers have in common a uniform and continuous outer casing and outer boundary surfaces.

This basic design principle was broken away from for the first time by the ClimaBalance product range according to EP 1 499 221. This innovative cover concept is characterised by the presence of a number of ventilation openings which are respectively spanned by meshwork with a defined air permeability. However, these are also a constant and continuous layer of a flexible insulating material, even if it is interrupted by ventilation openings.

This feature of known cover designs comprising a continuous layer of flexible insulating material results in the cover only being able to adapt to the body contours of the person sleeping under it to a certain extent. Moreover, the quantity of filler required in order to achieve a specific insulation effect is unsatisfactorily high. Furthermore, the appearance of the covers of the prior art is consistently understated, and at best determined by the geometric arrangement of the quilting seams and ribs. Apart from the aforementioned ClimaBalance covers, with the covers from the prior art there is no satisfactory dissipation of the heat and moisture generated by the body.

With regard to the prior art discussed above, the object forming the basis of the present invention is to provide a cover which allows improved adaptability, e.g. to the body contours of a person sleeping underneath. A further object underlying the present invention is to provide a blanket which allows a reduction of the filler weight while maintaining the same insulation effect. Furthermore, the present invention is based upon the object of providing a cover which guarantees satisfactory warmth and moisture dissipation, and so provides air-conditioning of the space taken up by the sleeper under the covers. In addition, the present invention has set itself the object of providing a cover which is characterised by a clearly different appearance from the present prior art. Moreover, the present invention is based upon the object of providing a cover which when used in hospitals offers advantages in practical use. Finally, the object underlying the present invention is to provide all of the advantageous properties described in this paragraph in equal measure without any associated disadvantages relating to handling or cleaning.

Furthermore, the present invention relates to the provision of sleeping bags and cushions which also have improved air-conditioning and adaptability to the body contours of the person sleeping in or on them.

Furthermore, the present invention relates to the provision of items of clothing which are based upon the design principle according to the invention and also have the aforementioned advantageous properties essential to the invention (contour adaptation, reduction of the filler weight, air-conditioning and attractive visual appearance).

In addition, the object underlying the present invention is to provide methods of producing the aforementioned products.

SUMMARY OF THE INVENTION

The aforementioned objects are achieved according to the invention by the cover according to the Claim 1 below wherein the continuous surface of conventional covers is broken away from by the presence of two or more groups of individual strips which at least partially lie on top of each other.

Preferred embodiments of this cover according to the invention are described in Claims 2 to 9 and 13 to 15 below.

In addition, the present invention relates to uses of the covers according to the invention in sleeping bags and items of clothing. Such uses are described in Claims 10 and 11 below.

Furthermore, the present invention relates to pillows according to Claim 11 below.

In addition, the present invention relates to support frame structures which together with correspondingly prepared strips can be used to form covers according to the invention.

The present invention further relates to methods of producing the covers according to the invention, as characterised in Claims 15-19 below.

DETAILED DESCRIPTION OF THE INVENTION

Definitions

Figure 1:
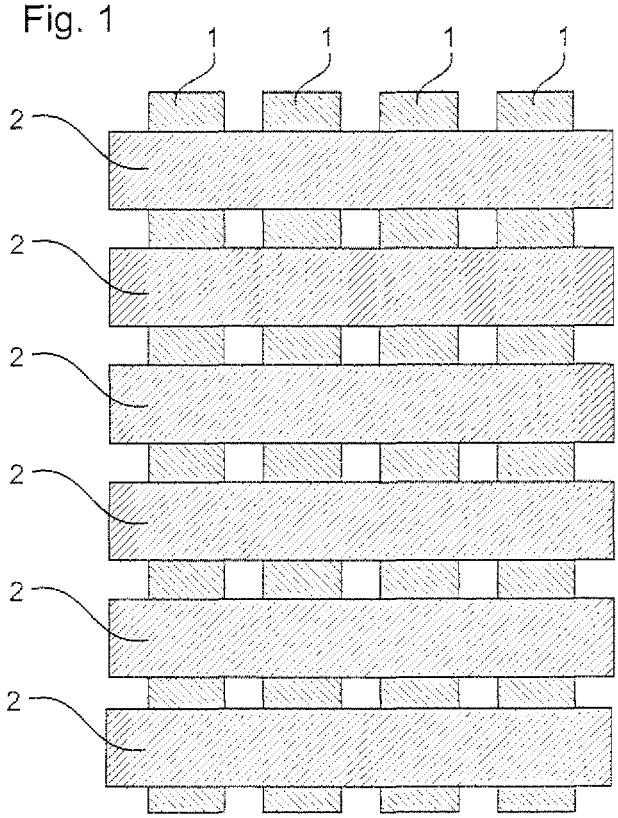
FIG. 1 illustrates diagrammatically a layered structure according to the invention.

Within the context of the present invention the term "down-proof" means that the casing material in question for the filler material to be used has the properties to be fulfilled according to standard EN 12132-2 (Stumpp test).

Within the context of the present invention the term "fibre proof" means that the casing material in question for the filler material to be used has the properties to be fulfilled according to standard EN 12132-2 (Stumpp test).

A "casing" is understood as meaning the textile material enveloping a filler which is directly or indirectly in contact with the filler, e.g. down.

Within the context of the invention a "cover" is understood as meaning any product suitable for covering or enveloping a person, animal or material, bed covers for people constituting a preferred embodiment.

Within the context of the invention a "cushion" is understood as meaning any article comprising one or more casings that is or are filled with soft filler material as a support for a person, an animal or a material. Examples of this are pillows, seat cushions, medical seat cushions, bolsters, dog cushions, heating pads or soft supports for the storage or conveyance of delicate materials, as well as bed or mattress overlays. Preferably, the present invention relates to pillows for people.

"Meshwork" is understood as meaning textile fabrics which have a high level of air permeability typically of 200 $l/dm^2$ min (measured with a drop in pressure of 200 Pa)-1000 $l/dm^2$ min (measured with a drop in pressure of 13 Pa), preferably 250 $l/dm^2$ min (with 200 Pa)-800 $l/dm^2$ min (with 13 Pa), and more preferably 300 $l/dm^2$ min (with 200 Pa)-600 $l/dm^2$ min (with 13 Pa), even more preferably 800 $l/dm^2$ min (with 200 Pa)-100 $l/dm^2$ min (with 13 Pa). This type of meshwork can be in the form of a coarse weave, but it can also consist of a perforated flat material made of a woven fabric, knit fabric, film or the like. These are typically textiles especially in the field of knit fabrics, such as for example open-work knit fabrics, in particular polyester open-work knit fabrics or charmeuse goods such as rhombus charmeuse or open-work charmeuse. From the domain of woven fabrics, gauze or mesh fabrics also constitute suitable meshwork. Furthermore, textile open-measured material, such as non-woven materials, in particular thermo-bonded spun non-woven materials, optionally with cut-out holes or fibres in bi- or multiaxial layered structure as also used as a reinforcing material in fibre-reinforced plastics are considered as meshwork. Advantageous examples of meshwork can be observed in the top view or phantom view with a 10 to 40%, preferably 15% to 30% proportion of openings such as holes, pores, free mesh space and the like.

Structure of the Cover

The cover according to the invention is characterised by a structure wherein two or more groups of respectively two or more strips are arranged relative to one another in different directions, the groups of strips at least partially lying on top of each other and being fixed relative to one another.

The presence of the different groups of strips makes it possible with the cover according to the invention to achieve a high degree of contour adaptability. This can possibly be brought about by a certain degree of displaceability of the strips relative to one another. However, the invention is not necessarily bound to this operating principle. In the case of woven strips the stretched length of the strips is greater than the width and length of the cover. This is due to the meandering path of the interwoven strips (working in). This additional length can act as the stretch length, and thus leads to even better contour adaptation. A better contour adaptation is also achieved by the open edges of the strips if the most continuous possible fixing of the strips does not take place at the edges. In particular, the open edges e.g. in association with panel/panel stitching of the cells of the strips lead to particularly good contour adaptation in the longitudinal and transverse direction in equal measure.

Furthermore, the presence of two or more groups of strips, which at least partially lie on top of each other, lead to the entrapment of air. This entrapped air allows the quantity of insulating material used to be reduced while the insulating effect of the cover remains the same.

An open structure of the cover according to the invention, e.g. open edges of the strips at the cross-over areas, allows in addition an improved air exchange in comparison with conventional covers between the space taken up by the sleeper under the cover and the external area, and so an improvement of the micro-climate within the space taken up by the sleeper under the covers.

At least partially laying the strips on top of each other reduces the risk of the insulating property of the cover being partially or totally lost by the filler slipping. More even distribution of the filler over the whole thickness of the cover is achieved.

According to one preferred embodiment the at least two groups of strips are arranged at a right angle relative to one another. However, alternative orientations are also conceivable which, for example, are present within an angle range of 45 to 135°, preferably 60 to 120°, more preferably 80 to 100° relative to one another.

According to one embodiment the two or more groups of strips can be laid on top of each other, and so form a so-called layer structure.

Alternatively to this the two or more groups of strips can be interwoven and so form a woven fabric. There is basically no restriction with regard to the type of weave. One must ensure, however, that the weave type in question can be produced with regard to the length, width and thickness of the strips. Particularly preferred are plain weaves and twill weave, matt weave, etc.

The strips can also be braided like a plait. In this embodiment it is not necessary to provide two separate groups of strip.

With layered structures and with most weave types it is conceivable to use more than two groups of strips. It is possible here for all of the groups of strips to have a different orientation in relation to one another (e.g. A-B-C structure). It is also possible for two or more groups of strips to have the same orientation, but to differ from one another in relation to a further group of strips. For example, two groups of strips can be arranged parallel to one another and be interwoven by means of a group of strips lying orthogonally between said group of strips (A-B-A structure). Structures with 2, 3 or 4 groups of strips and in particular structures with 2 or 3 groups of strips are preferred.

It is also possible to connect two covers according to the invention to one another undetectably or detachably according to the principle of duo covers or four seasons covers.

The number of strips per group is not specifically defined. It is at least two strips per group and can include a very high number such as for example 40 or even 80 strips per group. Typical exemplary embodiments of the present invention include 2 to 10 strips, and in particular 4 to 6 strips. With rectangular covers with groups of strips arranged at right angles to one another a structure with 4 strips along the longitudinal direction and 6 strips along the transverse direction of the cover is particularly preferred.

According to further embodiments of the present invention areas formed from strips can be combined with areas of the cover of the conventional type. A typical version of this embodiment is the version wherein a woven or layered strip structure is surrounded by a continuous conventional frame. Likewise, a number of these types of woven strip areas can be worked into a conventional cover. In particular, covers with 2 to 20, preferably 2, 3, 4, 5, 6, 7 and 8 of these types of area, and in particular covers with 2, 3 and 4 of these types of strip areas are to be considered as being in accordance with the invention. The areas can be of any shape, rectangles and diamonds being preferred. In this embodiment both filled and unfilled strips and combinations of the latter can be used.

A further aspect of the present invention relates to the possibility of using different filler and/or casing materials and/or filler weights for the different groups of strips. It is therefore conceivable, for example, to provide a group of strips filled with down which is combined with a second non-woven fabric-based quilted cover-type group of strips. Further typical combination possibilities include the combination of a filled group of strips with a second group of unfilled strips, for example strips made of a woollen weave. Furthermore, it is also possible within the framework of the present invention to further highlight the appearance of the cover according to the invention which is already unusual and interesting due to the three-dimensional structure by using differently coloured strips.

The groups of strips can be combined (e.g. woven) such that adjacent strips of the same group are in contact with one another or are spaced apart by any distance. The distances between adjacent strips can be chosen for each group of strips and also within the groups of strips independently of one another. Preferred distances are 0 to 100 cm, more preferably 0 to 20 cm, even more preferably 0 to 10 cm, typically 0.5 to 5 cm. The openings caused by these distances can be spanned by one or more layers of meshwork, as described in EP 1 499 221.

One essential aspect of the present invention is at least partial fixing of the two groups of strips to one another. This makes it possible to prevent the groups of strips from falling apart and/or from losing their shape. Therefore, every strip should be connected to the rest of the cover by at least one fixing. From a practical point of view it is advisable to fix each strip at least at the ends of the latter to the adjacent strip and/or the strip lying on top or below. Further reaching fixing of the strips, wherein with every or every other crossover point of the strips of two groups of strips at least one fixing is provided, has proven to be advantageous from the point of view of stability.

On the other hand, however, one should avoid considering overly intensive fixing of the respective groups of strips in order to guarantee minimum displaceability of the strips in relation to one another.

This type of loose and only partial fixing of the groups of strips to one another makes it possible to highlight to a particular extent the suitability according to the invention for adaptation to the body contours of the person sleeping.

Said fixing can be implemented by stitching or quilting the strips. However, fixing by means of hook-and-loop fasteners, snaps, zip fasteners, double mushroom buttons etc. is also conceivable. If a releaseable fixing with hook-and-loop fasteners etc. is chosen, the cover offers the particular advantage of separate washability of the individual strips or groups of strips by the end consumer.

As already mentioned, it is essential when selecting appropriate fixing points and the density of the latter to ensure that there is good adaptability to the body contours. If regular fixings are desired, e.g. in order to obtain an attractive external appearance, one option is to fix relative to one another two groups of strips lying on top of each other respectively at the corner points of the crossover areas. It is also possible, however, to use other fixing points, lines or areas and/or to decrease or increase the density of fixing points. It is conceivable, for example, to omit every other fixing point of the four fixing points per crossover point shown in FIG. 5. If lines are provided as fixing points it is preferable that for each crossover point of two strips, no more than four lines are provided the length of which is respectively no more than 50%, preferably 10-40%, of the average width of the two strips in question. If areas are provided as fixing points, it is preferred that for each crossover point of two strips, no more than four fixing areas are provided, the total area of which is no more than 20%, preferably 1-10%, of the area of the crossover point. Likewise, an irregular arrangement of the fixing points is conceivable provided this is acceptable with regard to the resulting visual appearance.

Alternative embodiments of the present invention relate to cover structures wherein the strips can at least partially be detached and then later be connected and fixed to one another again by the end consumer. The advantage of these embodiments is that individual strips can be renewed or be exchanged for alternative strips with different insulating effects, colours etc. Within the framework of the present invention it is possible and provision is made such that the end consumer can assemble a cover according to his requirements and personal preferences. For example, it is conceivable to assemble a cover wherein both in the area for the feet and in the area for the body a particularly strong insulating effect is achieved, but not, however, in the other areas. The specific omission of individual strips is also possible.

According to a first embodiment A of this type of the invention, a cover formed from two groups of strips is provided wherein the strips of one of the two groups of strips (hereinafter: the "first group of strips") are fixed relative to one another. They form a "support frame" into which the—loose—strips of the other second group of strips can be worked in e.g. in the manner of a plain weave. Within the framework of this embodiment it is preferred if the strips of the first group of strips are arranged parallel to one another and are fixed at regular distances to the respective adjacent strip. This attachment is preferably permanent. It is implemented, for example, by darts. It is an option here to choose the distances between the attachment points such that the spaces formed by the adjacent attachments correspond to the width of the strips of the second group of strips. When measuring the distances between the attachment points of the first group of strips it is advantageous to only allow small deviations of approx. 10% or less, more preferably approx. 5% or less. On the one hand this allows the strips of the second group of strips to be able to be introduced without these strips being too greatly compressed or crumpled. On the other hand, it is possible by choosing the distances appropriately to fix the strips of the second group of strips so that they do not slip.

Within the framework of this embodiment the strips of the first group forming the support frame can be arranged both in the longitudinal direction and in the transverse direction of the cover.

According to a further embodiment B of the present invention a cover is formed by two groups of loose strips being arranged nd fixed in an appropriate manner.

In a first version B1 of this embodiment the strips are fixed directly to one another in a detachable manner. With this version it is of particular significance to precisely specify the relative position of the strips and in particular of the fixing points in relation to one another so as to thus guarantee that the cover obtains the desired shape. This can be achieved, for example, by a plurality of locally precisely specified fixing elements such as e.g. elements of snap or hook-and-loop fastener connections.

According to a more preferred version B2 of this embodiment the arrangement provided for the strips is guaranteed by means of an additional support frame. This support frame can be implemented as follows:

One possibility B21 is to provide a support frame comprising a grid of double bands. Here the double bands are respectively formed by two parallel individual bands arranged on top of each other. The double bands are divided into two groups, the double bands of the one group being arranged parallel to one another in the longitudinal direction, and those of the other group in the transverse direction. The double bands of both groups are respectively fixed to one another at the crossover points (i.e. fixing within the double band as well as fixing of the two double bands in relation to one another). The distances between the double bands in both dimensions correspond to the width of the respective strips to be introduced, the requirements of the above paragraph applying here, i.e. deviations of less than 10% are preferred, and deviations of less than 5% more preferred. The double bands are further fixed by an encircling band. The length of the double bands corresponds to the length and width of the cover in the respective dimension. The width of the bands is not essential. It can be, for example, between 1 and 6 cm. Preferred widths of the bands are between 2 and 4 cm. It is preferred, furthermore, to provide releasable fixings for the strips of both groups of strips on the support frame structure. These releasable fixings are advantageously located at least at the ends of the respective strips and on the encircling band and/or at the ends of the double bands. It is also possible to fix the strip ends to the outermost strip of the other group of strips.

An alternative support frame structure B22 can be formed by a web of a textile fabric, preferably a woven material or a non-woven fabric. The textile fabric is provided with slots in the longitudinal and transverse direction, the width of which corresponds to the width of the strips to be introduced. In turn, it is preferred to restrict the deviations to less than 10%, more preferably to less than 5%. It is also preferred to provide a textile fabric with a low mass per unit area of 20 to 300 g/m$^2$, preferably 40 to 200 g/m$^2$, particularly preferably 60 to 120 g/m$^2$. One advantageous material is the non-woven fabric with the trade name "Evolon"® made by the company Freudenberg Evolon KG. It is also preferred within the framework of this embodiment to provide releaseable fixings of the strips of both groups of strips on the support frame structure. These releaseable fixing are advantageously located at least at the ends of the respective strips and on the corresponding edge areas of the textile fabric. Fixing of the strip ends on the outermost strip of the other group of strips is also possible.

It is also possible to provide a support frame structure B23 which basically corresponds to the support frame B22, with which, however, the slotted woven fabric forms the upper layer of a cover covering.

With the first version B1 of this embodiment it is essential to fix relative to one another the two groups of loose strips as accurately and as frequently as possible. For the other versions of the embodiments with detachable strips, further fixings are possible, but not compulsory, in the inner area of the covers.

With each of the embodiments A and B described above and variations of the latter, it is advantageous to fix the loose strips along the outer edge of the cover.

These fixings can be achieved as explained above (with the exception of quilting in order to guarantee the detachability of the strips), hook-and-loop fasteners, studs, snaps, loops, buttons with matching button holes and hooks and eyes being preferred.

Within the framework of these embodiments A and B relating to detachable strips all of the forms of strips described in the following can be used. The use of strips made of quilted cover material, wool, cotton, cashmere and camel hair is preferred.

In addition, the subject matter of the present invention is the support frame structures of embodiment A described above, as well as support frames B21, B22 and B23, as well as the loose strips described above which are prepared, however, for fixing at appropriate positions, e.g. by fitting with button holes, snaps, or bands at the positions in question, in particular at the edge. At least with version B1 further fixings are provided e.g. at the crossover points of the second group of strips.

The format of the cover according to the invention is not fixed. Typical embodiments are covers with the normal dimensions of covers: 135×200 cm and 155×220 cm but also foreign dimensions of e.g. 220×260 cm.

It is possible to introduce the covers according to the invention into permanent casings. However, with version B23 the casing is already integrated into the cover structure so that introduction into a (further) casing is possible but not wise.

Strips

The strips to be used according to the invention can be casings provided with filler or also unfilled strips of a flexible textile material.

The length of the strips is typically matched to the length of the area to be spanned (i.e. either to the length of the cover or to the length of the strip area in question within the cover). With woven covers this means that the strips are longer than the area to be spanned in order to guarantee the meandering path of the strips.

The width of the strips is not specified in greater detail. The strips to be used according to the present invention typically have a width of 2 to 80 cm, ranges from 5 to 70 cm, in particular from 10 to 60 cm being preferred. Preferred more are strips with a width of 20 to 55 cm, and very particularly preferred are strips with a width of 30 to 50 cm. With the embodiment according to the invention of a 4×6 cover with groups of strips arranged at right angles to one another for the currently well-established cover dimensions an ideal strip width of 36 to 39 cm is produced for covers with the normal format (135*200 cm) and a preferred range of 40 to 44 for the strip width of plus size covers (155*220 cm).

The individual strips can also be provided with one or more climate zones according to EP 1 499 221. With crossing strips the climate zones of the strips in question can lie on top of each other.

According to the present invention it is also conceivable to use different groups of strips which differ from one another e.g. in the respective width.

Strip Casing according to a typical embodiment of the present invention strips are used which consist of a casing comprising an upper and lower panel of a flexible material. This can be a casing made of a finely woven fibre- and down-proof cotton weave (so-called ticking) which can accommodate a conventional filler e.g. of down and/or feathers. Depending on the type of filler the material used for the casing can be varied. With non-woven fillers, as are typical for quilted covers, it is not necessary, for example, for the casing material to be down-proof.

Basically, all casing materials in all of the available colours are conceivable. Combinations of different colours in different strips are also possible.

The material of the casing can also include cashmere fibres according to DE Appl. No. 10 2007 001 433.5 or kapok fibres according to DE Appl. No. 10 2007 010 851.8. Of course the use of appropriate synthetic fibres within the framework of the present invention is also conceivable.

Knit fabrics and spunbonded fabrics can also be used. These are produced from natural and/or synthetic fibres and filaments. A preferably used natural fibre is cotton. The synthetic fibres and filaments are preferably selected from polyesters, e.g. polyethylene terephthalate (PET), polyolefins such as polypropylene (PP), polyamides, for example Cordura, or polyaramides such as Kevlar®, Nomex®, or mixtures thereof. The use of fibres which contain ceramic material is also possible within the framework of the invention. An appropriate fibre is for example the Trevira Bioactive® fibre. Alternatively, one can use filament weaves, for example non-woven fabrics or micro-fibre fleeces, e.g. Evolon® made by the company Freudenberg Evolon KG, as described in DE 20 310 279 U1 and WO 01/47383 A1. These microfibre fleeces are characterised not only by their air and vapour permeability, but also by their mite allergen-resistant properties.

Mixtures of the aforementioned materials can also be used within the framework of the present invention.

Within the framework of the present invention it is furthermore preferable to divide the strip casings into individual cells in order to fix the filler better over the strip length and width. All of the conventional embodiments are possible here, and in particular a direct connection of the upper and lower panel of the casing is possible, or the insertion of partition walls, the so-called ribs, between the upper and lower panel of the casing. When filling with bulk material such as down, feathers, fibre balls, etc. filler openings are to be provided at the connection points of the upper and lower panel.

Of course it is also conceivable according to the present invention to use different groups of strips which differ from one another by the casing material used.

Strip Filler

The individual strips can be provided with all of the filler materials used for conventional covers. There are no restrictions here either. Fillers made of feathers, down, natural fibres and animal hair such as e.g. kapok fibres or wool, synthetic fibres such as e.g. fibre balls and fibrous non-woven webs and latex, e.g. natural rubber, are preferred. Suitable synthetic fibres can be made of polyester and/or polyamide. Hollow fibres can also advantageously be used within the framework of the present invention. Furthermore, foam can be used as a filler material. Here one can specify in particular so-called polyurethane sticks (i.e. small polyurethane rods typically with a length of 9 to 40 mm (preferably 18 to 20 mm) and a cross-section typically of (4 to 12 mm)×(2 to 6 mm), preferably (7 to 9 mm)×(3 to 5 mm) which are called "PU sticks" in the following), or foam balls. Preferred foam materials are polyether urethane, polyester urethane and foams made of viscoelastic rubbers, etc. The weights per unit volume of the preferred foams come within the range of 15 to 55 kg/m$^3$, PU sticks more preferably being produced from materials with a weight per unit volume of 18 to 24 kg/m$^3$. The compression hardnesses of the materials are preferably 1.0 to 5.0 kPa, measured according to DIN 53577. With PU sticks materials with compression hardnesses of 1.0 to 2.0 kPa are preferred. A further suitable filler material is foam structure plates. Preferred are foam structure plates with small segment sizes in the region of 5-50 cm, more preferably 10-35 cm, particularly preferably 10-20 cm in every dimension. Suitable as a filler material are also gels which are available in the form of gel cushions or gel structure plates (e.g. honeycomb structure). Also possible are combinations of foam structure plates and gel structure plates. Natural materials such as spelt grains and cherry stones can also be used. The latter filler materials (foam and natural materials) are particularly an option for use in cushions.

Within the framework of the present invention it is moreover possible to combine strips with different filler weights and/or different filler materials. This is possible both within one group of strips and between the groups of strips.

Unfilled Strips

In addition to the strips provided with filler described above, it is furthermore possible within the framework of the present invention to provide one or more groups of strips which only consist of an unfilled material. This can typically be a textile fabric such as e.g. a woven fabric, knit fabrics, non-woven fabric, meshwork, charmeuse goods, bi- or multiaxial weave. Typical examples of this textile fabric are woven and knitted woollen materials made e.g. of cashmere wool, woven cotton materials, open-work knit fabrics, in particular made of polyester, fleece material, rhombus charmeuse or open-work charmeuse, gauze, voluminous non-woven fabrics e.g. as used for the filling of commercially available quilted covers, thermo-bonded spun non-woven materials, optionally with cut-out holes, materials made of polyacylnitrile fibres (PAN) and others. Mixtures of these materials, such as e.g. mixtures of PAN and cotton can also be used.

There are no restrictions in principle. In fact, the strip material to be used can be selected as required with regard to softness, insulation properties, suitability for the dissipation of moisture, price, equipment variations, functional features, etc. The use of unfilled strips is particularly an option in combination with a further group of strips which is formed from strips provided with a filler.

Production Methods

The covers according to the invention can be produced as follows: In the case of the use of filled strips there are two alternative production methods which are identified as method a and method b in the following:

According to method a the individual strips are initially provided with filler, and are then brought relative to one another into the desired spatial orientation, for example by laying or weaving the already filled strips. In a final step the groups of strips are fixed relative to one another, for example by stitching, buttoning to one another or quilting. The method steps of method a can therefore be characterised as follows:

a1. providing a desired number of strip casings;

a2. filling the strip casings with the desired filler;

a3. positioning the strips relative to one another in the desired spatial arrangement; and a4. fixing the groups of strips in relation to one another.

Method b is characterised by a partially inverted sequence of method steps. Here initially in a first step the spatial orientation of the strip casings in relation to one another is established, and only then is the filler introduced into the individual strips. According to two alternative methods the fixing of the strips can take place before or after the filling. The method steps of method b can be summarised as follows:

b1. providing a desired number of strip casings;

b2. positioning the strip casings relative to one another in the desired spatial arrangement;

b3. filling the strip casings with the desired filler material;

b4. fixing the strips in relation to one another.

An alternative to the above method is the following method version:

b1. providing a desired number of strip casings;

b2. positioning the strip casings relative to one another in the desired spatial arrangement;

b3'. fixing the strips in relation to one another;

b4'. filling the strip casings with the desired filler material.

This alternative method version is preferred. If unfilled strips are used, the step of filling the latter is of course omitted. In this case the following method applies: In the case of quilted cover-type strips and/or covers the following method c is preferred.

c1. providing a desired number of filled strips;

c2. positioning the strips relative to one another in the desired spatial arrangement; and c3. fixing the groups of strips in relation to one another.

When using quilted cover-type strips in combination with alternative filled strips method c can be combined appropriately with each of the above methods a and b, e.g. by the sequence (b1)-(c1)-(b2 or c2)-(b3' or c3)-(b4').

Equipment

The strips to be used according to the invention can be provided with any equipment which is also used with conventional covers. There are no restrictions with regard to this. It is therefore conceivable, for example, to equip the strips with fibres containing ceramic, Simtex fibres (fibres containing metal and/or metal-coated fibres) or carbon fibres. The filler can also be coated with small ceramic particles, as described in DE Appl. No. 10 2006 017 338.4. Furthermore, the strips can be provided with measuring probes. They can, moreover, be provided with a heating grid. It is also possible to provide them with antibacterial materials, aromatic materials, phase change materials, materials for dissipating electromagnetic vibrations, optical fibres as illuminating and functional elements, and of course the provision of visual embellishments.

Applications

One advantage of the covers according to the invention is the fact that the covers have remarkably good insulating properties in relation to the filling weight due to the bulbous structure of the filled strips and due to the duo cover effect because of the strips lying on top of each other. Therefore, the present covers make it possible to reduce the cover weight and/or to improve the insulating effect as required. Thereby no sweaty, clammy feeling develops in the space taken up by the sleeper under the covers despite the good insulating effect since its woven open structure of the covers enables an exchange of air and moisture between the space taken up by the sleeper under the covers and the surrounding area. One should further highlight the outstanding adaptation of the cover to the body contours of the person sleeping underneath. This property is achieved by the structure of the cover which is free from flexural stresses even in the deformed state. Panel/panel stitching of the strips can even further reinforce this effect.

The most important practical application of the covers according to the invention is in the domain of covers for beds. This relates on the one hand to the private end consumer, but on the other hand also to the commercial domain, e.g. the use of covers in hotels and hospitals. In hospitals in particular the open structure of the covers according to the invention can be advantageous since the cover according to the invention does not form a closed surface as do conventional covers, but there are openings between the individual strips by means of which IV lines or similar can easily be introduced.

Further applications of the cover according to the invention are to be found in the domestic and wellness domain, e.g. as a snuggling blanket on the sofa. With this application the conspicuous and attractive external appearance of the cover according to the invention is particularly advantageous.

Further possible applications of the cover according to the invention are to be found in the covering of other objects and/or living beings, in particular in cases where good contour adaptation and/or breathing activity is important. Typical examples of these applications are the covering of pieces of furniture and/or horse rugs.

Furthermore, the covers according to the invention can also be made into and/or be used as sleeping bags. The sleeping bags according to the invention are suitable for use in sport, camping and/or travel. They can be provided both for outdoor and indoor use, the latter form being preferred. With sleeping bags in particular the structure according to the invention based on strips leads to outstanding advantages during use: both the better contour adaptation and the improved suitability for dissipating excess body warmth and moisture lead to a particularly high level of comfort with the sleeping bag totally enveloping the body of the sleeping person. Moreover, the reduction of the quantity of filler required makes it possible to reduce the conveyance weight of the sleeping bag and the packed volume. Preferably only the upper side (cover side) of the sleeping bag need be formed according to the invention.

A further possible application of the concept according to the invention is the production of items of clothing from filled or unfilled groups of strips. For example, it is conceivable to produce a down jacket or a down coat from interwoven down-filled strips.

Cushions

A further, particularly essential possible application for the present invention relates to use in cushions. Basically the same design principles, materials to be used and processing steps are applicable here, as described above in connection with the covers according to the invention. Of course cushion-specific peculiarities are to be taken into account here which may necessitate adaptations. For example, the format of the cushions is smaller that that of the covers according to the invention. Typical cushion formats are 40×40 cm, 40×80 cm, 80×80 cm and other dimensions.

Certain cushion-specific adaptations can also be made with the fillers. In comparison to covers fillers with more voluminous and/or more rigid filler materials are an option so as to thus achieve an increased supporting effect of the cushion. All fillers and materials used with conventional cushions can be used within the framework of the present invention, in particular down, feathers, fibre balls, microfibres, spelt grain and cherry stones as well as PU sticks and foam and/or gel structure plates.

The number of strips per group of strips is reduced due to the smaller format in comparison to the covers according to the invention. Typical groups of strips comprise approximately 2 to 6 strips, preferably 2 to 4 strips.

In addition to an advantageous contour adaptation, even beneath the sleeping person, the use of the cushions according to the invention, in particular in combination with the covers according to the invention, is advantageous in order to thus be able to achieve a uniform appearance. Correspondingly, the present invention additionally relates moreover to sets of covers and cushions which have this type of uniform appearance.

Specific Exemplary Embodiments

FIG. 1 shows an embodiment of the present invention in which there are two groups of strips which form a layered structure: The strips of the one group of strips (1) are located continuously above the strips of the second group of strips (2).

In FIG. 1 a preferred embodiment of a fabric is shown with which the two groups of strips are arranged at a right angle to one another.

Figure 2:
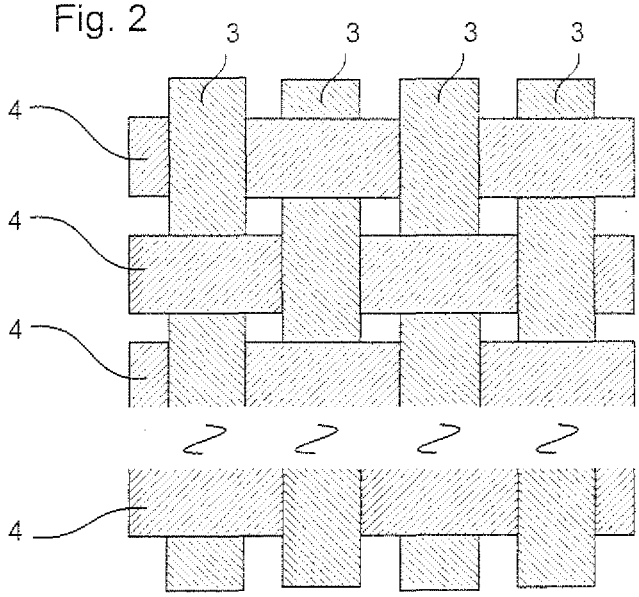
FIG. 2 illustrates diagrammatically a woven version of the cover according to the invention.

FIG. 2 shows a further embodiment of the present invention, wherein there are two groups of strips (3) and (4) which are interwoven and so form a fabric. In the embodiment shown in FIG. 2 the woven fabric is once again characterised by strips arranged at right angles to one another. A plain weave is shown. It can easily be seen from FIG. 2 that the strips of the group of strips (3) are located alternately above and below the strips of the group of strips (4).

Figure 3:
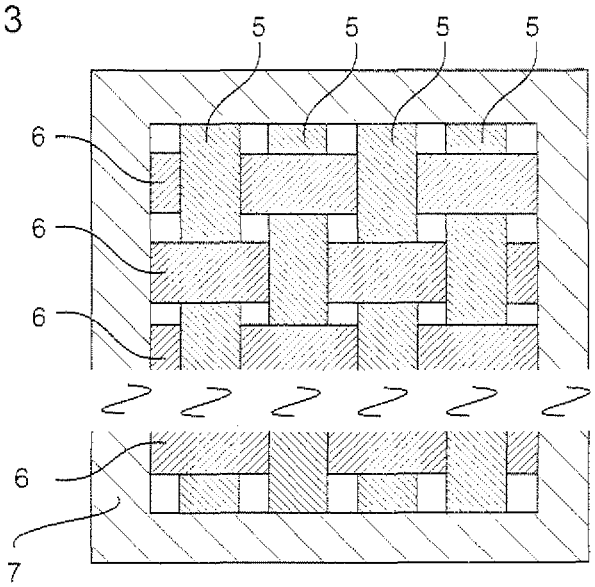
FIG. 3 illustrates diagrammatically a woven version of the cover according to the invention which is surrounded by a tubular sleeve of conventional design.

FIG. 3 shows a further embodiment of the present invention. In this embodiment a woven fabric made up of two groups of strips (5) and (6) arranged at right angles to one another is provided which is edged by a filled sleeve (7) of the conventional type. The width of this sleeve or the aerial proportion of the woven area are not specified in any greater detail, the advantages according to the invention being of particular significance, however, when the woven area takes up at least 60% of the whole area, more preferably 80% and particularly 90% of the whole area. Furthermore, it is possible within the framework of the present invention to provide an edging of unfilled material, such as e.g. a woollen weave, instead of a sleeve.

Figure 4:
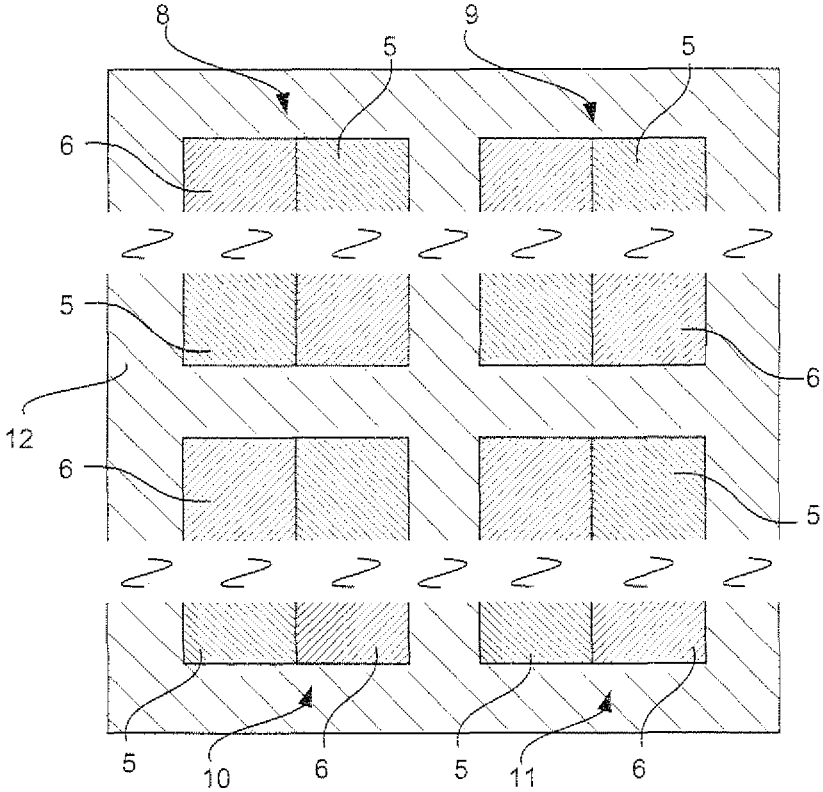
FIG. 4 illustrates an alternative embodiment of the cover according to the invention wherein a number of woven cover areas are surrounded by a conventional tube-like cover area and are connected to one another.

FIG. 4 shows a further embodiment of the present invention which differs from the embodiment according to FIG. 3 in that instead of a single woven area used, a number of—in the present illustration four—woven areas (8, 9, 10 and 11) are used in an edging and connecting conventional filled sleeve (12). Of course the number of strips per woven area is reduced if the number of woven areas increases, and so the area of each individual woven area decreases.

Figure 5:
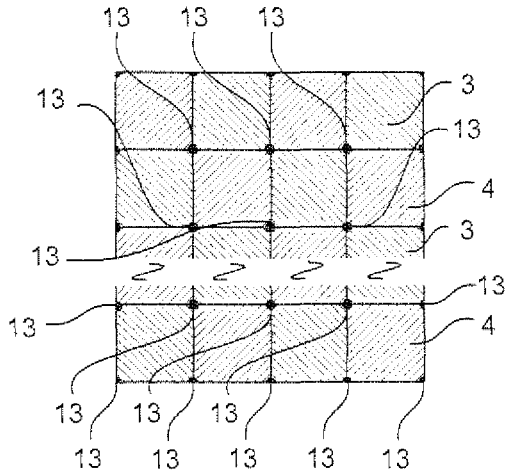
FIG. 5 illustrates diagrammatically a woven version of the cover according to the invention similar to FIG. 2, but with fixing points.

FIG. 5 shows a cover according to the invention as in FIG. 2, but additionally shows a possibility for arranging the fixing points (13; in order to increase clarity, not all of the fixing points are identified by reference numbers in FIG. 5).

With this embodiment too it is conceivable to substitute the filled conventional sleeve (12) with an unfilled textile fabric such as e.g. a woollen weave.

Figure 6:
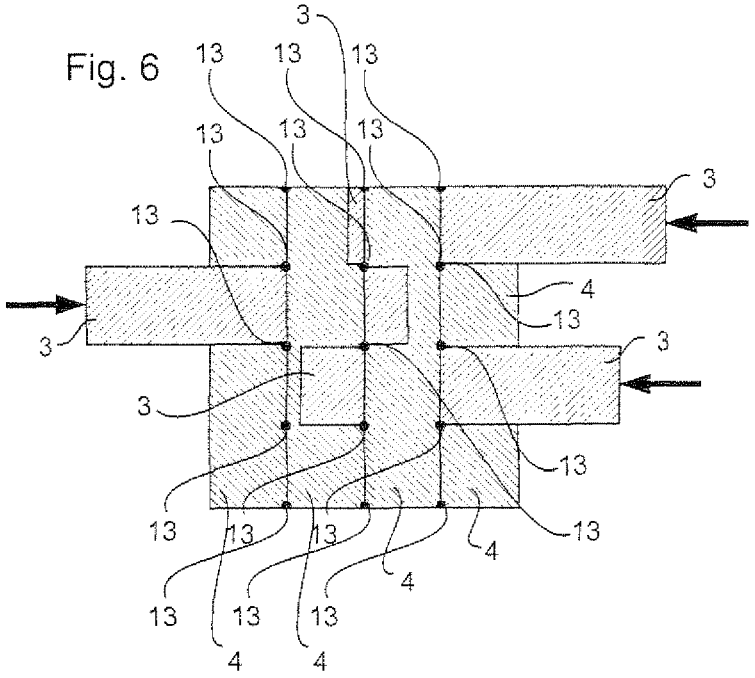
FIG. 6 illustrates diagrammatically a support frame structure described below according to embodiment A into which the transverse strips are inserted.

FIG. 6 shows a support frame structure according to embodiment A. This support frame structure is formed by strips (4) of a first group of strips wherein each strip (4) is connected to the respective adjacent strips (4) by attachment points (13). The strips (3) of the second group of strips are inserted transversely into this support frame structure. Releasable fixings of the strips (3) of the second group with the strips (4) of the first group are advantageously provided—e.g. at the ends of the strips (3) and optionally also in the central area at the crossover points—but are not shown in FIG. 6 for reasons relating to clarity.

Figure 7A:
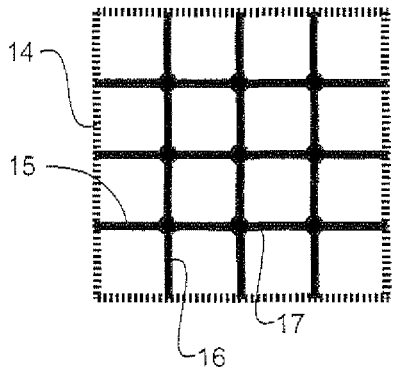
FIG. 7 illustrates diagrammatically a support frame structure described below according to embodiment B21, FIG. 7*a* illustrating the support frame structure in a top view, and FIG. 7*b* in a side view.
Figure 7B:
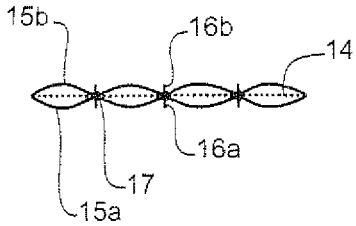

FIG. 7 shows a support frame structure according to embodiment B21. The support frame structure of this embodiment is formed by a grid of double bands (15 and 16). Here the double bands (15 and 16) are respectively formed by two parallel individual bands arranged on top of each other (15*a* and 15*b*, and 16*a* and 16*b*). The double bands are divided into two groups (15 and 16), the double bands of the one group (15) being arranged parallel to one another in the longitudinal direction, and those of the other group (16) being arranged in the transverse direction. The double bands of both groups are respectively fixed to one another at the crossover points (17). The strips of both groups of strips (not shown in FIG. 7) are guided through the openings formed by double bands 15*a* and 15*b* and double bands 16*a* and 16*b*, and so are fixed in their position.

Figure 8:
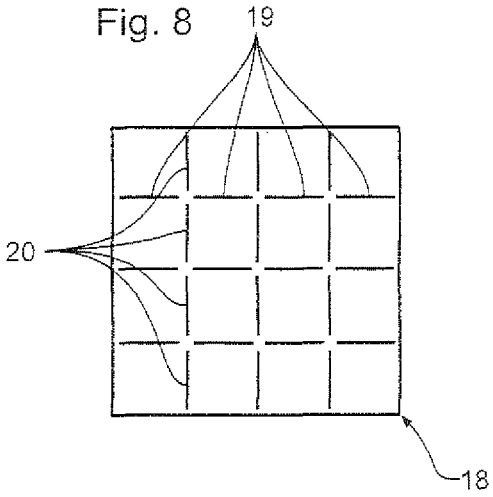
FIG. 8 illustrates diagrammatically a support frame structure described below according to embodiment B22.

FIG. 8 shows a support frame structure according to embodiment B22. This is a textile fabric (18) that is provided with slots in the longitudinal direction (20) and with slots in the transverse direction (19). The strips of the two groups of strips (not shown in FIG. 8) are guided through the slots (19) and (20) and so are fixed in their position.

With each of the embodiments shown above it is possible to provide each one of the groups of strips shown in the filled or unfilled form. Of course, in particular with smaller woven areas, the more flexible unfilled strips e.g. made of polyester, wool and/or cotton weave are preferred. It is also preferred to adapt the width of the respective strips to the overall size of the woven area, i.e. with small woven areas narrow strips, and with large woven areas wide strips are preferably to be provided. Typically the width of the individual strips is approximately 5 to 50%, preferably 10 to 40% of the respective width of the woven or layered area.

EXAMPLE

4×6 cover quilted in squares, 135×200 cm, made up of 4 longitudinal strips and 6 transverse strips, arranged at right angles in relation to one another in the form of a plain 1/1 weave.

Casing Material:

100% cotton, plain weave, woven fabric quality of the company Gebr. Sanders GmbH & Co. KG, FB 135.

| | |
|---|---|
| Warp: | yarn count Nm 135, threads/cm: 62 |
| Weft: | yarn count Nm 135, threads/cm: 59 |
| Total weight: | approx. 90 g/m$^2$ |

Casing:

Longitudinal sleeves divided into 6 equally sized cells with respectively panel/panel stitching of the upper and lower panel; transverse sleeves divided into 4 equally sized cells respectively with panel/panel stitching of the upper and lower panel. 5 cm wide filler openings are taken into account respectively on the cell separation seams. The fixing of the sleeves in relation to one another was implemented with circular quilting seams with a diameter of 20 mm at all of the corners of the crossover points according to FIG. 5.

Due to the meandering path of the sleeves with a plain weave the so-called finished size of the casing (stretched sleeve length without filling) is:

longitudinal sleeve: 207 cm, transverse sleeve: 139 cm.

Filler:

Respectively 8 g per cell, 48 cells in total, consequently 384 g total filling with a 100% class 1 Hungarian goose down according to EN standard EN 12934.

The cover was produced according to method version b1 to b4'.

The invention claimed is:

1. A cover, in particular a cover for beds, comprising:

two or more groups of strips, wherein each group comprises two or more strips, at least two groups of strips are arranged relative to one another in different directions, the two or more groups of strips are arranged at least partially on top of each other, and the two or more groups of strips are partially fixed relative to one another;

wherein at least one group of strips is produced from casings made of ticking material which are filled with a filler selected from feathers and/or down, natural fibers, synthetic fibers and foam particles.

2. The cover according to claim 1, wherein one or more of the strips and/or one or more of the groups of strips consist of unfilled strips, and preferably woven woolen material.

3. The cover according to claim 2, two or more unfilled strips being provided, and the filled and unfilled strips of the same group of strips being arranged in sections, alternately or in blocks.

4. The cover according to claim 1, wherein the two or more groups of strips are interwoven.

5. The cover according to claim 1, wherein two groups of strips woven in a plain weave are provided.

6. The cover according to claim 1, wherein the cover is provided with a circumferential edge made of conventional cover material.

7. The cover according to claim 1, wherein the cover is formed by the presence of two or more areas separated from one another by conventional cover material, said areas being formed, as described in claim 1, from two or more groups of respectively two or more strips.

8. The cover according to claim 1, wherein the groups of strips are fixed relative to one another by stitching, quilting, hook-and- loop fasteners, buttons, double mushroom head buttons or snaps.

9. The cover according to claim 1, wherein the two or more groups of strips differ from one another as regards material and/or width.

10. A sleeping bag which is made at least partially from a cover according to claim 1.

11. An item of clothing which is made at least partially from a cover according to one or more of the preceding claim 1.

12. The cover according to claim 1 which is in the form of a cushion.

13. The cover according to claim 1, wherein one or more of the individual strips is provided with one or more ventilation openings spanned with meshwork, the climate zones of the respective strips preferably lying on top of each other when the strips cross each other.

14. The cover according to claim 1, wherein one or more of the strips or groups of strips being made of a meshwork.

15. A method of producing a cover according to claim 1, wherein either unfilled strips are used or strips are used the structure and filler of which correspond to a quilted cover, and wherein the method comprises the following steps:

c1. providing a desired number of optionally filled strips;

c2. positioning the strips relative to one another in the desired spatial arrangement; and c3. fixing the groups of strips in relation to one another.

16. A process of producing a cover according to the method of claim 15, comprising (A) the use of a support frame, consisting of (a) a group of three or more strips arranged in parallel which are respectively attached to the adjacent strips by means of three or more fixings;

(b) two groups of crossing double bands which are respectively fixed at the crossover points to one another and to an encircling band; or (c) a textile fabric that is provided with slots at regular intervals in the longitudinal and the transverse direction;

and/or (B) the use of a strip selected from (i) strips which are produced from casings of ticking material and which are provided with a filler selected from feathers and/or down, natural fibres, synthetic fibres and foam particles, and (ii) unfilled strips, preferably woven wool material, wherein the strip is provided with one or more devices for attaching further strips or a support frame according to embodiment (A).

17. A method of producing a cover according to claim 1, comprising the steps:

a1. providing a desired number of strip casings made of ticking material;

a2. filling the strip casings with the desired filler;

a3. positioning the strips relative to one another in the desired spatial arrangement; and a4. fixing the groups of strips in relation to one another or b1. providing a desired number of strip casings made of ticking material;

b2. positioning the strip casings relative to one another in the desired spatial arrangement;

b3. filling the strip casings with the desired filler material; and b4. fixing the strips in relation to one another or c1. providing a desired number of strip casings made of ticking material;

c2. positioning the strip casings relative to one another in the desired spatial arrangement;

c3. fixing the strip casings in relation to one another; and c4. filling the strip casings with the desired filler material.

18. A process of producing a cover according to the method of claim 17, comprising (A) the use of a support frame, consisting of (a) a group of three or more strips arranged in parallel which are respectively attached to the adjacent strips by means of three or more fixings;

(b) two groups of crossing double bands which are respectively fixed at the crossover points to one another and to an encircling band; or (c) a textile fabric that is provided with slots at regular intervals in the longitudinal and the transverse direction;

and/or (B) the use of strips which are produced from casings of ticking material and which are provided with a filler selected from feathers and/or down, natural fibres, synthetic fibres and foam particles.

19. The method according to claim 17, comprising steps c1, c2, c3 and c4 in this sequence.

* * * * *